US012397967B2

(12) United States Patent
Demir et al.

(10) Patent No.: US 12,397,967 B2
(45) Date of Patent: Aug. 26, 2025

(54) PLASTIC CONTAINER

(71) Applicant: ALPLA Werke Alwin Lehner GmbH & Co. KG, Hard (AT)

(72) Inventors: Adem Demir, Lauterach (AT); Klemens Bösch, Lustenau (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 0 days.

(21) Appl. No.: 18/002,972

(22) PCT Filed: Jun. 25, 2021

(86) PCT No.: PCT/EP2021/067544
§ 371 (c)(1),
(2) Date: Dec. 22, 2022

(87) PCT Pub. No.: WO2022/002797
PCT Pub. Date: Jan. 6, 2022

(65) Prior Publication Data

US 2023/0312175 A1 Oct. 5, 2023

(30) Foreign Application Priority Data

Jun. 30, 2020 (CH) ..... 00802/20

(51) Int. Cl.
*B65D 23/10* (2006.01)

(52) U.S. Cl.
CPC ..... *B65D 23/104* (2013.01)

(58) Field of Classification Search
CPC ... B65D 23/104; B65D 23/106; B65D 23/108
USPC ..... 220/755, 770
See application file for complete search history.

(56) References Cited

U.S. PATENT DOCUMENTS 2,950,032 A * 8/1960 Willis ..... A47G 19/12 222/465.1
4,257,525 A * 3/1981 Thompson ..... B65D 23/102 215/396
5,279,443 A * 1/1994 Koda ..... B65D 25/30 206/203

(Continued)

FOREIGN PATENT DOCUMENTS

CA 2 059 169 A1 7/1992
DE 81 32 602 U1 3/1982

(Continued)

OTHER PUBLICATIONS

International Search Report Corresponding to PCT/EP2021/067544 mailed Oct. 14, 2021.

(Continued)

*Primary Examiner* — Anthony D Stashick
*Assistant Examiner* — Niki M Eloshway
(74) *Attorney, Agent, or Firm* — Finch & Maloney PLLC

(57) ABSTRACT

Disclosed is a plastic container (1, 1") comprising a container body (10, 10', 10"), which forms a filling volume, and a reach-through opening (11, 11") penetrating the container body (10, 10', 10"). The reach-through opening (11, 11") forms a handle (12, 12', 12", 12'") with a partial region (10*a*, 10*a'*, 10*a"*) of the container body (10, 10', 10"). A handle insert (13, 13', 13", 13'") is arranged in the reach-through opening (11, 11").

17 Claims, 5 Drawing Sheets

(56) References Cited

U.S. PATENT DOCUMENTS

Figure 1:
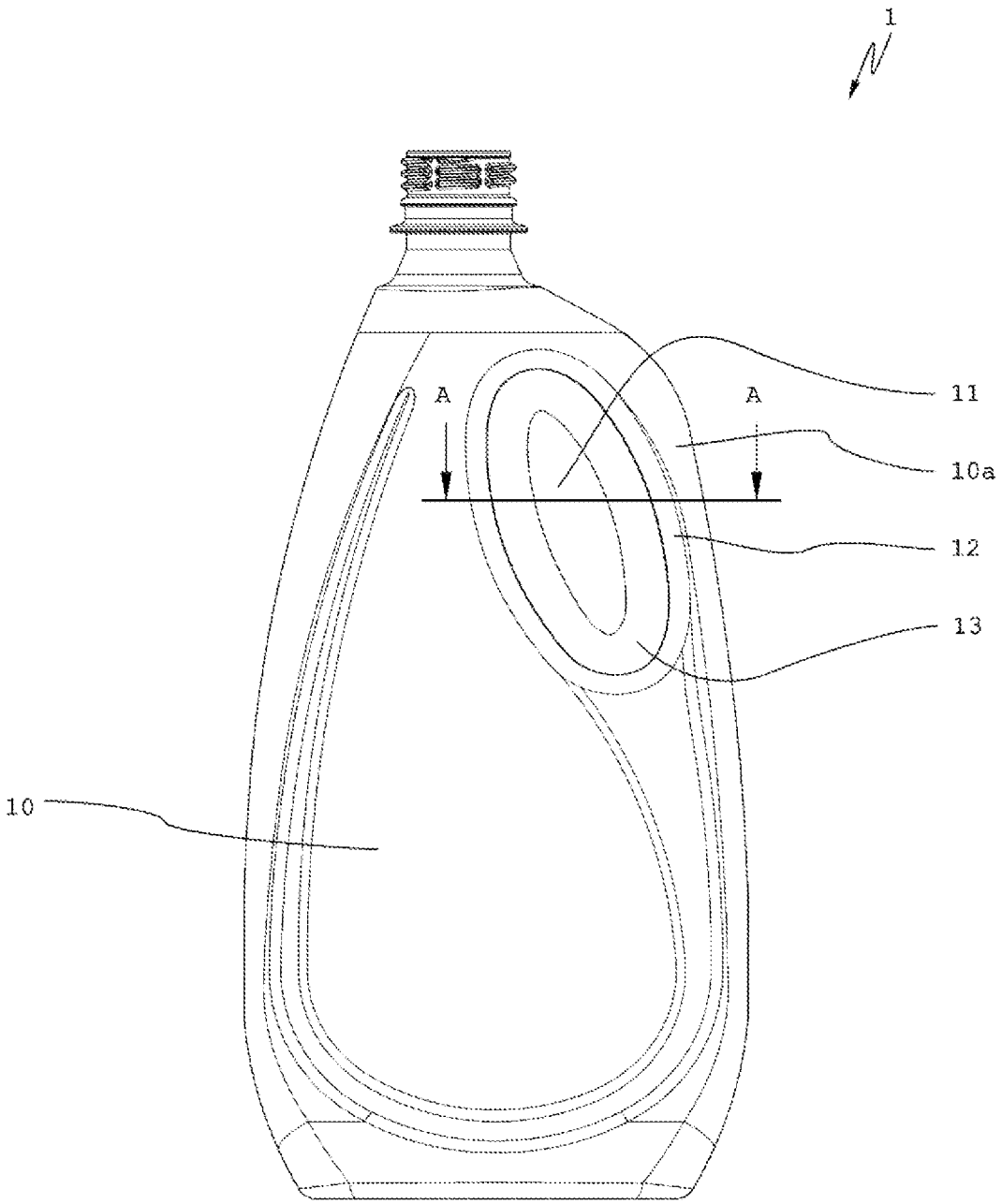

| | | | | |
|---|---|---|---|---|
| 5,287,991 | A * | 2/1994 | Koda | B65D 25/30 220/769 |
| 7,600,655 | B2 * | 10/2009 | Agrawal | B29C 65/562 215/396 |
| 8,540,096 | B1 * | 9/2013 | Robbins, III | B65D 23/104 215/396 |
| 9,386,865 | B2 * | 7/2016 | Bally | A61B 50/33 |
| 11,186,403 | B2 * | 11/2021 | Demir | B65D 23/10 |
| 2003/0019091 | A1 * | 1/2003 | Wunderlich | B65D 23/106 29/453 |
| 2010/0187195 | A1 | 7/2010 | Jamieson et al. | |
| 2019/0075914 | A1 * | 3/2019 | Teper | B65D 23/12 |

FOREIGN PATENT DOCUMENTS

| | | | | |
|---|---|---|---|---|
| EP | 1 835 461 | A2 | 9/2007 | |
| JP | S63-32142 | U | 3/1988 | |
| JP | 105-26836 | U | 4/1993 | |
| JP | 07172439 | A * | 7/1995 | B65D 23/10 |
| JP | 2000-016435 | A2 | 1/2000 | |
| WO | 2017/211540 | A1 | 12/2017 | |

OTHER PUBLICATIONS

Written Opinion Corresponding to PCT/EP2021/067544 mailed Oct. 14, 2021.

* cited by examiner

PLASTIC CONTAINER

The present invention relates to a plastic container according to the preamble of the independent claims.

Many plastic containers are known from the prior art.

Various methods are known for the production of plastic containers, in particular plastic bottles, the application of said methods also being dependent, not least, on the plastics used. Usually, the plastic containers are produced in a blow-molding process in which plastic containers, for example plastic bottles, are inflated into their final shape by overpressure in a blow mold. In the case of blow molding, different process techniques are distinguished, of which in particular the extrusion blow-molding process, the injection blow-molding process, and the injection stretch blow-molding process should be mentioned. In the extrusion blow-molding process, a single- or multi-layer plastic hose is extruded hot, introduced into a blow mold, and inflated to form a plastic container via a blowing mandrel introduced into a mold cavity of the blow mold. The injection blow-molding process is a combination of injection molding and blow molding. In this case, a preform is first produced in an injection-molding process in an injection mold. The preform is demolded from the injection mold, optionally conditioned, and introduced into the mold cavity of a blow mold, in which it is finally inflated with overpressure in accordance with the shape predetermined by the mold cavity. Here, only the region of the preform lying below the neck is inflated, the neck typically already having its final shape after the injection molding. In the injection stretch blow-molding method, the preform introduced into the mold cavity is additionally stretched with a stretching mandrel during the blow-molding process. The inflation of the preform can be carried out directly after its production in the injection-molding method. In alternative production methods, the further processing of the preforms can also take place spatially and/or temporally separately from the production of the preform. Finally, it should also be mentioned that the preforms can also be produced in an extrusion process or also in an extrusion blow-molding process.

In addition, plastic containers have been known which have an integral handle, wherein it has been found that essentially only plastic containers which have a handle that is offset from the rest of the container and can be completely grasped by the hand have become established with users. A relatively simple solution for providing such handles is achieved in that the plastic container has a reach-through opening passing through a container body.

WO 2017/211540 A1 discloses a plastic container, in particular made of PET, which has a reach-through opening and a corresponding handle. The reach-through opening of the plastic container of WO 2017/211540 A1 is obtained in that, after the stretch blow-molding of the plastic container, two wall parts are welded together and then a corresponding region separated from the container by the weld seam is cut out of the container.

A comparable plastic container made of polypropylene has become known with EP 1 835 461 A2.

Both plastic containers have a connection seam lying in the reach-through opening. Under certain circumstances, this can form a weak point on the plastic container, which can be disadvantageous in particular in the mail-order sector in which the handling of the products cannot be fully monitored and these products are loaded above their permitted limits time and time again. Since this connection seam is produced on the finished blown plastic container, it must be carefully rounded for a pleasant feel and in particular to reduce the risk of injury to the user, which makes additional processing steps necessary.

It is therefore the object of the invention to overcome at least one or more disadvantages of the prior art. In particular, a plastic container is to be provided which is sturdy, preferably has an attractive appearance, and in particular has a pleasant feel and/or entails a reduced risk of injury.

This object is achieved by the plastic container defined in the independent claim. Further embodiments result from the dependent claims.

A plastic container according to the invention has a container body, forming a filling volume, and a reach-through opening passing through the container body. The reach-through opening forms a handle with a partial region of the container body. A handle insert is arranged In the reach-through opening. A partial region of the handle insert is thus also part of the handle.

The handle insert which is arranged in the reach-through opening, in particular completely within the reach-through opening, makes it possible to provide a contour/inner contour for the handle that is independent of the contour and/or the size, i.e. the specific design, of the reach-through opening. In this case, it is made possible in particular to provide molds or structures which are not easily producible in a blow-molding process.

The provision of a handle insert in the reach-through opening also makes it possible for a connection seam, for example a weld seam, which possibly extends within the reach-through opening along a circumference of the reach-through opening, to be covered with the handle insert, so that the connection seam is no longer accessible to a user.

The handle insert thus runs completely along the inner contour or the circumference of the reach-through opening in order to cover the connection seam.

In the region of the reach-through opening, the container body has two mutually separate cross-sections, which are connected to each other above and below the reach-through opening and thus form a common filling volume. In this case, the cross-section of the partial region which forms the handle is typically many times smaller than the further cross-section.

It can be provided that the handle insert has a parting plane.

This allows the insertion of the handle insert into the reach-through opening also in the case of configurations of the handle insert, in the region of its outwardly directed ends or surfaces, which are greater than the clear cross-section of the reach-through opening, so that a partial region of the container body extending along the periphery of the reach-through opening can be covered with the handle insert.

In this case, it is conceivable that the parting plane is arranged substantially in the direction of the reach-through opening, so that the handle insert can be inserted into the reach-through opening in a substantially helical manner.

A two-part design of the handle insert with a parting plane in the direction of the reach-through opening is also conceivable. This makes it possible to insert a first half of the handle insert into the reach-through opening and to displace it substantially along the mold parting plane of the plastic container and to insert a second half of the handle insert substantially similarly into the reach-through opening and to displace it in the opposite direction.

Preferably, the handle insert is formed in two parts and has a first shell and a second shell.

This allows the insertion of the handle insert into the reach-through opening in sections from several sides.

The parting plane of the handle insert can be formed substantially parallel to a mold parting plane of the plastic container.

The formation of the parting plane substantially parallel to the mold parting plane of the plastic container makes it possible to introduce the handle insert, divided into two halves, which in the present case correspond to a first shell and to a second shell of the handle insert, from two sides into the reach-through opening. This allows simple and in particular machine mounting of the particular handle insert in the plastic container.

In this case, it can be provided that the first shell has a first contact surface and the second shell has a second contact surface, these being directed towards each other. In other words, substantially complementary surfaces are provided on the first shell and on the second shell and can be brought into contact and/or into operative connection with each other.

On the one hand, this allows a specific distance between the outer surfaces of the handle insert to be maintained, on the other hand, corresponding connection means can be provided and/or attached to these surfaces, which allow the first shell to be connected to the second shell.

The first contact surface and the second contact surface can be connected to each other, in particular glued to each other or welded together.

Accordingly, an adhesive is provided as the connection means, wherein this adhesive can be applied in this case simply to the corresponding contact surfaces and connects them to each other as soon as they are pressed against each other.

A welding also allows a secure and permanent connection of the first shell to the second shell via the contact surfaces. However, welding is not suitable for all plastic materials, and therefore more or fewer preparation measures for welding must be taken for different plastics materials.

However, it can also be provided that the connection between the first shell and the second shell is additionally or alternatively formed mechanically. It can be provided that the first shell and the second shell be connected to each other via a snap-in connection.

A snap-in connection is distinguished in that a first element is connected to a second element, wherein one of the elements is at least partially elastically deformed and this deformation is completely reversed after the connection has been established. It is also possible that the deformation only partially reverses, so that the connection is also under a certain tension in the final state.

In this case, an opening or an undercut can be formed on the first element, for example on the first shell, and an elastically deformable projection on the second element, that is to say on the second shell, can engage in the corresponding undercut or in the corresponding opening.

It would also be conceivable for a threaded connection to be provided as connection means in the case of a handle insert which is rotationally symmetrical about an axis.

The plastic container can have a circumferential projection within the reach-through opening. The handle insert can have a first pressing element and a second pressing element, wherein the first pressing element and the second pressing element rest against the projection under pretension.

It goes without saying that the pretension is present in the fully assembled state, i.e. when the first shell and the second shell are connected to each other.

This makes it possible to compress the plastic container in the region of the reach-through opening, in the present case the projection, and to reduce a load occurring within the projection and/or to dissipate a load to the handle insert. This results overall in a stiffening of this region. It can be provided that a circumferential connection seam is arranged within the reach-through opening.

The arrangement of the connection seam within the reach-through opening makes it possible to cover and/or shield this connection seam with the handle insert.

The connection seam can be formed as part of the projection. Due to the formation as part of the projection, this connection seam is accessible before the insertion of the grip region and can be arranged at a certain distance from the rest of the container body. In other words, the connection seam is spaced apart from the container body in the direction of the center of the reach-through opening via the projection to the container body.

A further aspect of the invention relates to a plastic container. This has a container body, which forms a filling volume, and a reach-through opening passing through the container body. The reach-through opening forms a handle with a partial region of the container body. A handle insert can be arranged in the reach-through opening. In this case, a partial region of the handle insert is thus also part of the handle. The plastic container is in particular formed as described herein.

The plastic container can have load-relief notches in the reach-through opening. The load-relief notches make it possible to reduce the energy of a shock wave, which is transferred from the liquid to the plastic container in the event of an impact of a plastic container filled with liquid.

The load-relief notches are formed as a depression in the plastic container.

The load-relief notches can be formed as part of the projection. As seen from a center of the reach-through opening in the direction of the plastic container or in the direction of the partial region of the plastic container which belongs to the handle, these load-relief notches can form an undercut with respect to the projection. The free cross-section in this direction is thus constricted. In the projection, there is thus an extension or bulge relative to the load-relief notch.

The undercuts form tips inside the plastic container. These tips are flexible, that is to say they yield to some extent when a shock wave hits and thus absorb part of the energy of the shock wave.

In addition, the space in the region of the projection expands relative to the narrowest cross section. This widening or bulge leads to turbulence in the liquid, which further reduces the energy of the shock wave.

It can be provided that the handle insert has projecting elements which engage at least partially in these load-relief notches.

On the one hand, this increases stability, and on the other hand the position of the handle insert in relation to the plastic container can be improved or more precisely maintained.

Preferably, the load-relief notches are covered by the handle insert. This improves the feel and the appearance of the plastic container.

In the case of a configuration of the plastic container as described in the present case, in which the handle insert with its first pressing element and its second pressing element sets the projection under pretension, the connection seam can be load-relieved correspondingly. Forces which occur, for example, in the event of vibrations or in the event of improper treatment of the plastic container, can thus be at least partially absorbed by the handle insert and the resulting forces acting on the connection seam are significantly reduced.

The first pressing element and/or the second pressing element can be formed in several parts. The pressing element in question can be formed, for example, from a plurality of individual ribs.

On the one hand, this makes it possible to save material and, on the other hand, the pretension can be introduced at points into the projection.

Preferably, the handle insert has reinforcing ribs, in particular arranged between the particular pressing element and an associated surface. This surface is, in each case, the outwardly directed surface of the handle insert, which provides a surface of the handle.

A configuration with reinforcement ribs is particularly advantageous if the surface of the handle insert is at a large distance from the container body and/or if a high degree of overlap between the handle insert and the container body is desired.

The plastic container can be a stretch blow-molded plastic container, in particular produced from PET, PET-G, EBM-PET, HDPE, LDPE, PP, PS, PVC, PEN, PHA, PHB, PEIT, PCTG, LLDPE, MDPE and copolymers of the stated plastics, bioplastics, in particular PLA or PEF, filled plastics and mixtures of the plastics named.

The handle insert can be an injection-molded part, in particular produced from PET, PET-G, HDPE, LDPE, PP, PS, PVC, PEN, PHA, PHB, PEIT, PCTG, LLDPE, MDPE and copolymers of the plastics named, bioplastics, in particular PLA or PEF, filled plastics, and mixtures of the plastics named.

Preferably, the plastic container and the handle insert are produced from the same material.

A complicated separation process can be dispensed with in the event of recycling.

As already discussed, the handle insert is arranged in the reach-through opening. This means that the handle insert, for example, does not fully encompass any elements or partial regions of the plastic container. The handle insert is preferably arranged completely within an enclosing outer contour of the plastic container. In other words, the surfaces of the handle insert do not protrude beyond the enclosing outer contour of the plastic container.

The invention is explained in greater detail with reference to exemplary embodiments on the basis of figures which are shown only schematically.

Figure 2:
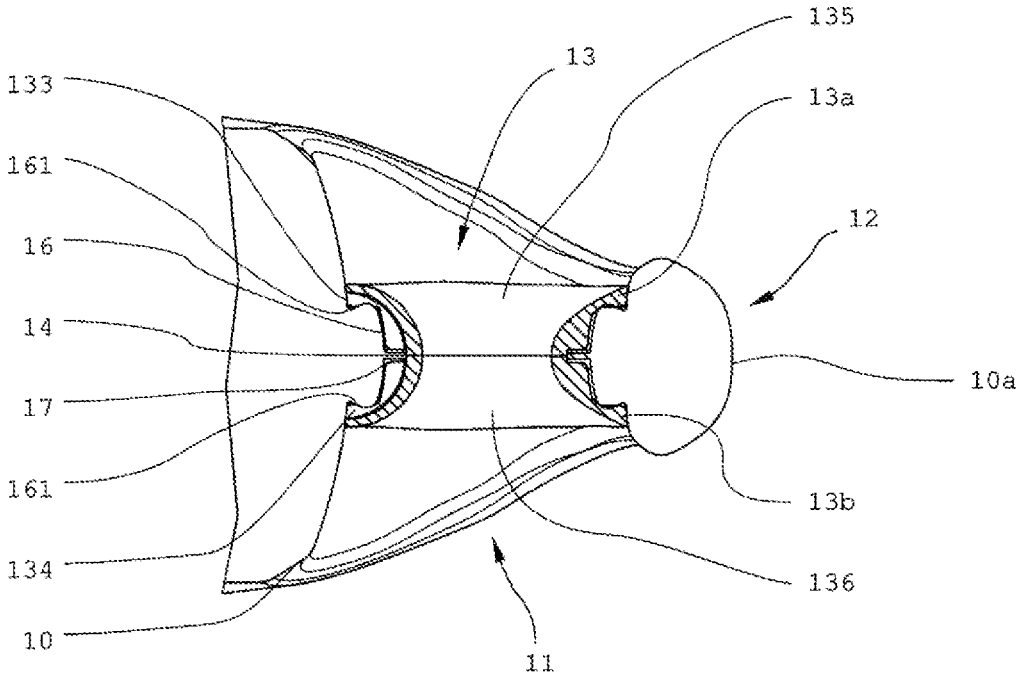
Figure 3:
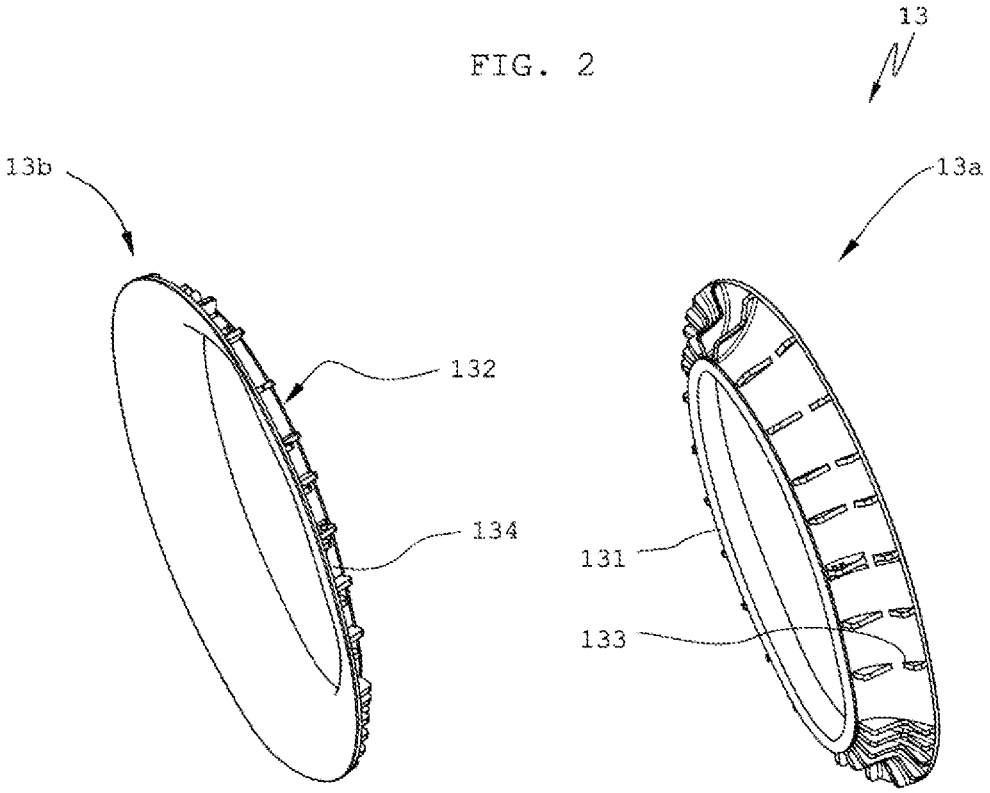
Figure 4:
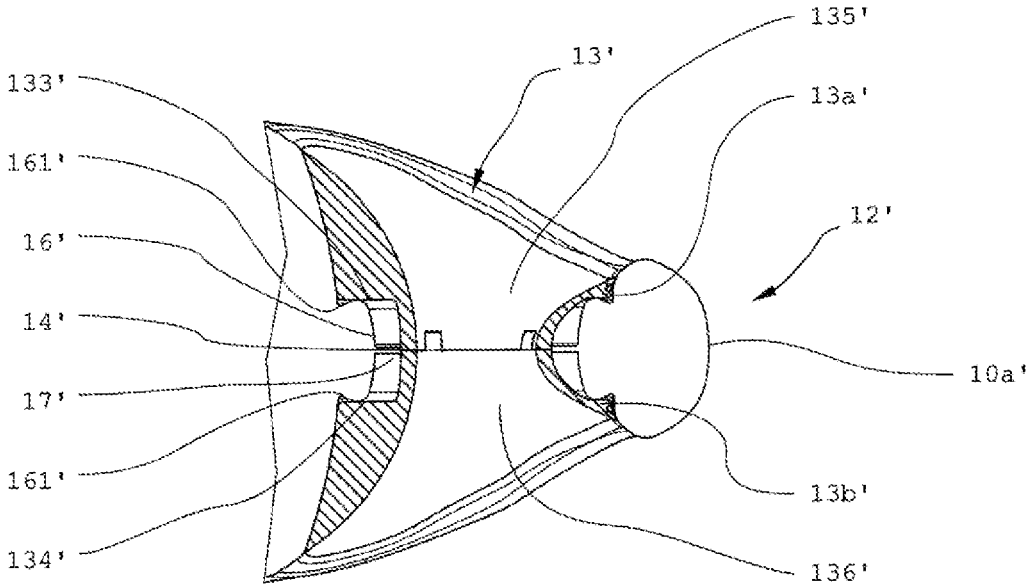
Figure 5:
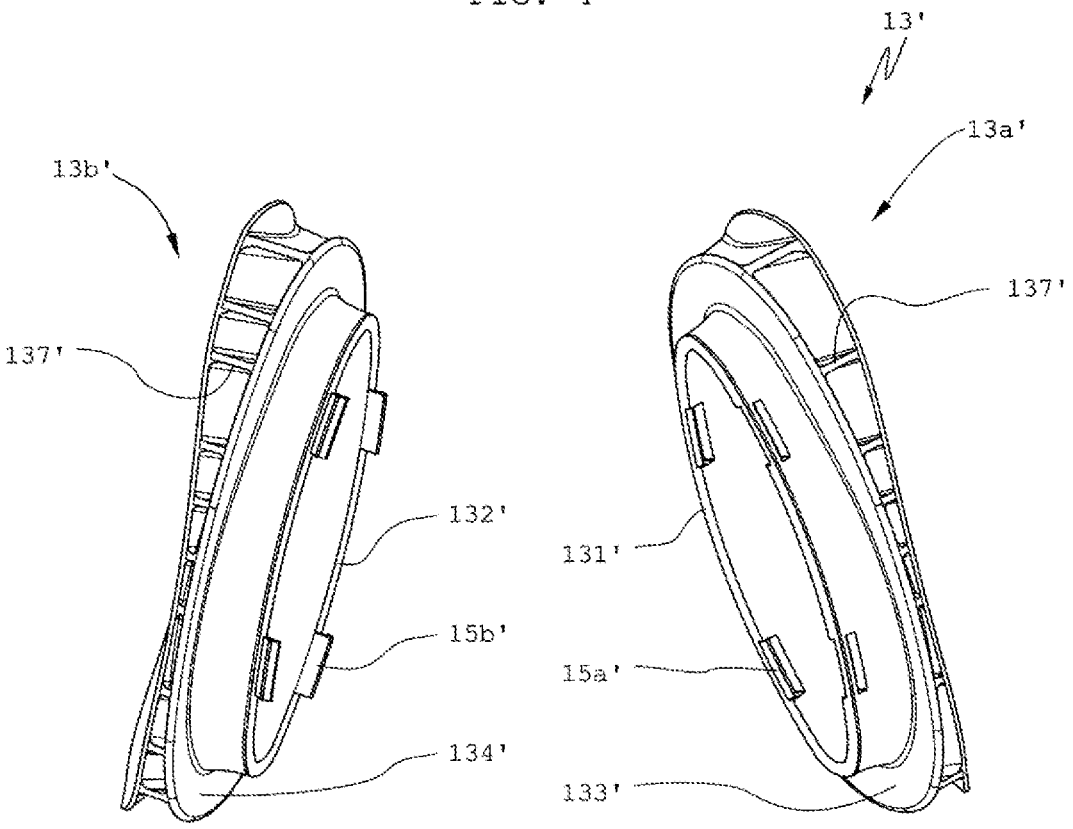
Figure 6:
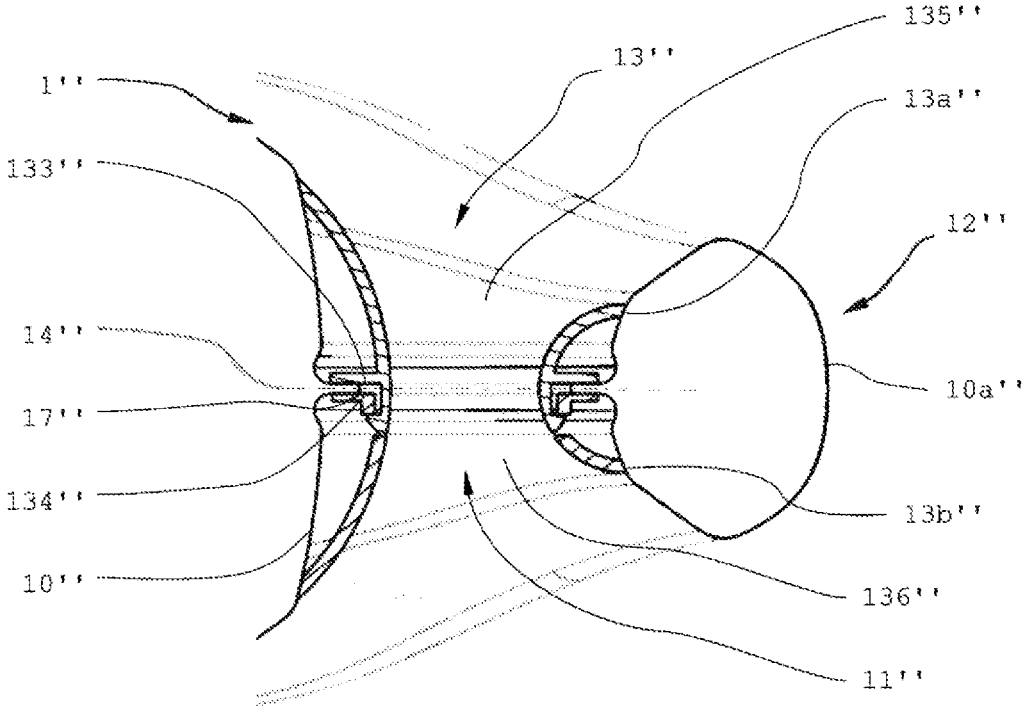
Figure 7:
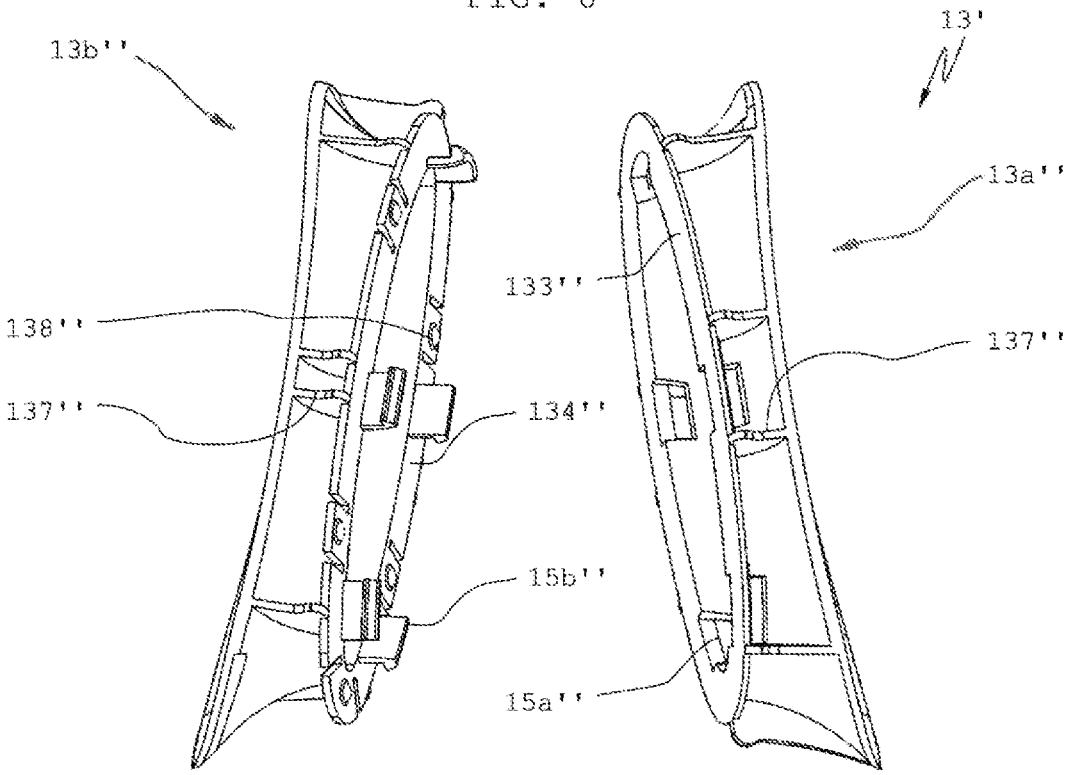
Figure 8:
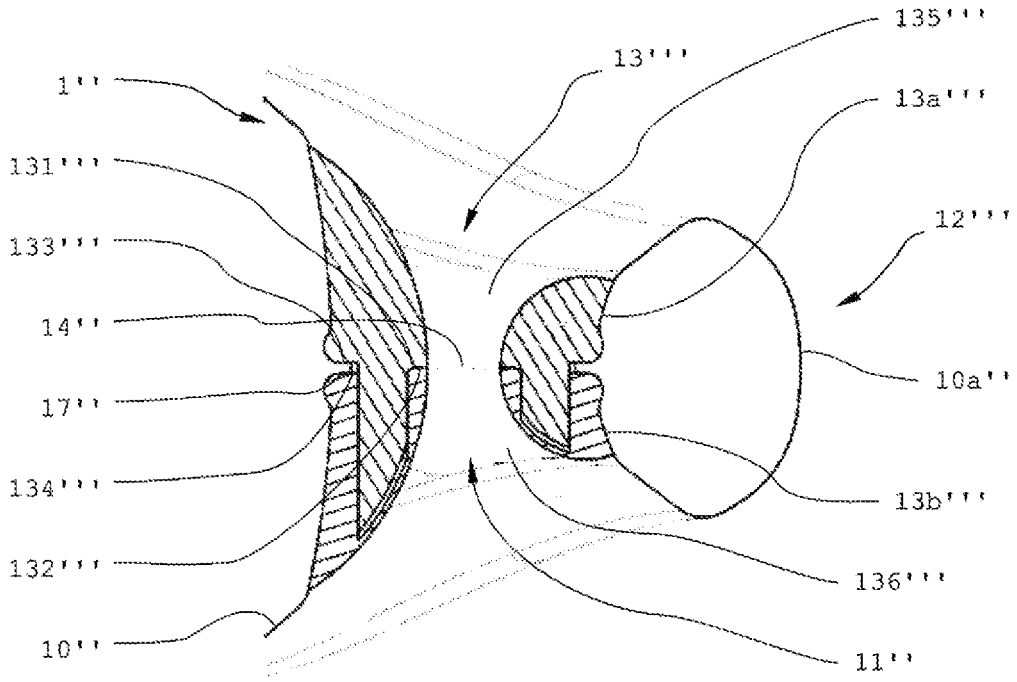
Figure 9:
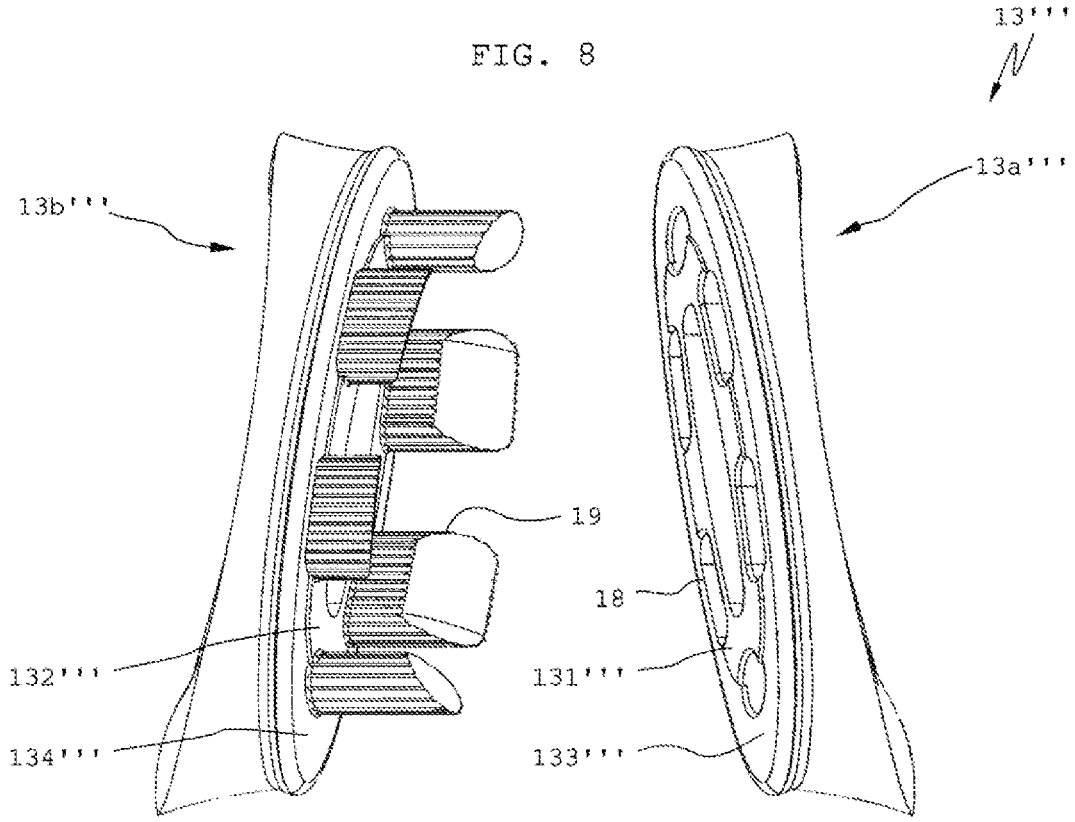

These show:

FIG. 1: a plastic container;

FIG. 2: a sectional view of FIG. 1 along the line A-A;

FIG. 3: an exploded view of the handle insert of FIG. 2;

FIG. 4: a view corresponding to FIG. 2 of a further embodiment of the plastic container;

FIG. 5: an exploded view of the handle insert of FIG. 4;

FIG. 6: an alternative embodiment of the handle insert of FIGS. 4 and 5;

FIG. 7: an exploded view of the handle insert of FIG. 6;

FIG. 8: a further embodiment of a handle insert;

FIG. 9: an exploded view of the handle insert of FIG. 8.

FIG. 1 shows a plastic container 1 which has a container body 10. The container body 10 provides a filling volume that is not denoted in greater detail. The container body 10 is passed through by a reach-through opening 11 and thus is formed in two parts in the region of the reach-through opening 11. The container body 10 thus has two different cross-sections in this region. A handle insert 13 is arranged within the reach-through opening 11. The handle insert 13 forms a handle 12 with a partial region 10*a* of the container body 10 for holding and manipulating the plastic container 1.

FIG. 2 shows a sectional view of FIG. 1 along the line A-A. A handle insert 13 is arranged within the reach-through opening 11. In the present case, the handle insert 13 has a first shell 13*a* and a second shell 13*b*, which are connected to each other along a parting plane 14. The parting plane 14 lies substantially in a mold parting plane (not denoted in greater detail) of the plastic container 1 (see FIG. 1). The handle insert 13 together with a partial region 10*a* of the container body 10 forms a handle 12. The handle insert 13 has a first outwardly directed surface 135 and a second outwardly directed surface 136. In the present case, "outwardly directed" means that the outer surface or surface in question faces an outer contour of the plastic container 1. Nevertheless, the handle insert 13 is arranged completely within the enclosing outer contour of the plastic container 1. In other words, the surfaces 135 and 136 of the handle insert do not project beyond the enclosing outer contour of the plastic container 1. In the region of the reach-through opening 11, the enclosing outer contour is the contour that the plastic container 1 would have if no reach-through opening 11 were provided, that is to say if there were a substantially continuous connection of the surfaces of the container body 10 surrounding the reach-through opening. The first shell 13*a* has a first pressing element 133 and the second shell 13*b* has a second pressing element 134. In the region of the reach-through opening 11, the container body 10 has a circumferential projection 16 on which there is arranged a connection seam 17. In the present embodiment, the circumferential projection 16 has two outwardly directed curvatures or bulges. These are connected to the plastic container via a load-relief notch 161. The cross-section thus has a constriction in the region of the load-relief notch 161 and an extension in the region of the projection 16. The first pressing element 133 and the second pressing element 134 are operatively connected to the projection 16 and in the present case to the respective curvatures. The first shell 13*a* and the second shell 13*b* lie against each other via first and second contact surfaces 131, 132 (see FIG. 3). Accordingly, a specific distance that is less than a minimum width of the circumferential projection 16 at the corresponding point is provided between the first pressing element 133 and the second pressing element 134. The circumferential projection 16 is thus compressed by the first pressing element 133 and the second pressing element 134 and is placed under pretension. Forces which occur in this region are thus absorbed by the handle insert 13. The connection seam 17 lying within a contour of the handle insert 13 is therefore load-relieved.

FIG. 3 shows an exploded view of the handle insert 13 of FIG. 2 in a three-dimensional view. The handle insert 13 comprises a first shell 13*a* and a second shell 13*b*. The first shell 13*a* has a first contact surface 131. Arranged along the periphery of the first contact surface 131 is a first pressing element 133, which in the present case is formed from individual ribs. The second shell 13*b* also has a second contact surface 132. A second pressing element 134 is likewise arranged along the periphery of the second contact surface 132. The second pressing element 134 is also formed from individual ribs. In proper use, the first contact surface 131 faces the second contact surface 132.

In the present case, the first contact surface 131 and the second contact surface 132 are substantially flat. In this embodiment, to connect the first shell 13*a* to the second shell 13*b*, an adhesive is applied to the first and/or second contact surfaces 131, 132 and the first shell 13*a* and the second shell 13*b* are pressed together with their contact surfaces 131, 132.

FIG. 4 shows a sectional view corresponding to the view of FIG. 2 through a plastic container 1. The plastic container 1 corresponds to that of FIG. 1. A handle insert 13' is arranged within the reach-through opening 11. The handle insert 13' is also arranged completely within the outer contour of the plastic container 1. In the present case, the handle insert 13' has a first shell 13*a'* and a second shell 13*b'*, which are connected to each other along a parting plane 14'. The parting plane 14' lies substantially in a mold parting plane of the plastic container 1, which is not denoted in greater detail. The handle insert 13' forms a handle 12' jointly with a partial region 10*a'* of the container body 10. The handle insert 13' has a first outwardly directed surface 135' and a second outwardly directed surface 136'. In the present case, "outwardly directed" means that the outer surface or surface in question faces an outer contour of the plastic container 1. The first shell 13*a'* has a first pressing element 133' and the second shell 13*b'* has a second pressing element 134'. In the region of the reach-through opening 11, the container body 10 has a circumferential projection 16 on which there is arranged a connection seam 17'. In the present embodiment, the circumferential projection 16' has two outwardly directed curvatures or bulges. These are connected to the plastic container via a relief notch 161'. The cross-section thus has a constriction in the region of the relief notch 161' and an extension in the region of the projection 16'. The first pressing element 133' and the second pressing element 134' are operatively connected to the projection 16' and in the present case to the respective curvatures. The first shell 13*a'* and the second shell 13*b'* lie against each other via first and second contact surfaces 131', 132' (see FIG. 5). Accordingly, a specific distance that is less than a minimum width of the circumferential projection 16' is provided between the first pressing element 133' and the second pressing element 134'. The circumferential projection 16' is thus compressed by the first pressing element 133' and the second pressing element 134' and is placed under pretension. Forces which now occur in this region are thus absorbed by the handle insert 13'. The connection seam 17' lying within a contour of the handle insert 13' is therefore load-relieved.

FIG. 5 shows an exploded view of the handle insert 13' of FIG. 4 in a three-dimensional view. The handle insert 13' comprises a first shell 13*a'* and a second shell 13*b'*. The first shell 13*a'* has a first contact surface 131'. Arranged along the periphery of the first contact surface 131' is a first pressing element 133', which in the present case is formed as a circumferential shoulder. The second shell 13*b'* also has a second contact surface 132'. A second pressing element 134' is likewise arranged along the periphery of the second contact surface 132'. The second pressing element 134' is also formed as a circumferential projection. In proper use, the first contact surface 131' faces the second contact surface 132'.

In the present case, the first contact surface 131' and the second contact surface 132' are substantially flat. In this embodiment, to connect the first shell 13*a'* to the second shell 13*b'*, four snap-in connections 15*a'*, 15*b'* are provided, with only one of the snap-in connections 15*a'*, 15*b'* being denoted and explained in more detail in the present case for the sake of clarity. The snap-in connection 15*a'*, 15*b'* has a first element 15*a'* and a second element 15*b'*, with the first element 15*a'* being formed as an opening with undercut and the second element 15*b'* being formed as an elastically deformable projection. During joining, the elements 15*a'* and 15*b'* engage with each other so that a connection between the first shell 13*a'* and the second shell 13*b'* is produced.

The handle insert 13' according to FIG. 5 is provided with reinforcement ribs 137' which are each arranged between the first pressing element 133' and the associated surface 135' or between the second pressing element 134' and the associated surface 136'.

FIG. 6 shows an alternative embodiment of the handle insert 13' of FIGS. 4 and 5. FIG. 6 shows a sectional view corresponding to the view of FIG. 2 through a plastic container 1". A handle insert 13" is arranged within the reach-through opening 11". The handle insert 13" is also arranged completely within the outer contour of the plastic container 1". In the present case, the handle insert 13" has a first shell 13*a"* and a second shell 13*b"*, which are connected to each other along a parting plane 14". The parting plane 14" lies substantially in a mold parting plane of the plastic container 1", which is not denoted in greater detail. The handle insert 13" forms a handle 12" jointly with a partial region 10*a"* of the container body 10". The handle insert 13" has a first outwardly directed surface 135" and a second outwardly directed surface 136". In the present case, "outwardly directed" means that the outer surface or surface in question faces an outer contour of the plastic container 1". The first shell 13*a"* has a first pressing element 133" and the second shell 13*b"* has a second pressing element 134". In the region of the reach-through opening 11", the container body 10" has a circumferential connection seam 17" which projects from the container body 10" and thus provides an element corresponding to the projection 17' of the exemplary embodiment according to FIG. 4. In the present embodiment, the circumferential connection seam 17" has two substantially planar portions of the walls of the plastic container 10". These planar portions are connected to the plastic container via load-relief notches (not denoted in greater detail). The first pressing element 133" and the second pressing element 134" are operatively connected to these walls and thus to the connection seam 17". The first pressing element 133" and the second pressing element 134" press the walls of the connection seam 17" against each other, so that the connection seam 17" is under pretension.

Forces which now occur in this region are thus absorbed by the handle insert 13". The connection seam 17" lying within a contour of the handle insert 13" is therefore load-relieved.

FIG. 7 shows an exploded view of the handle insert 13" of FIG. 6 in a three-dimensional view. The handle insert 13" comprises a first shell 13*a"* and a second shell 13*b"*. The first shell 13*a"* has a first pressing element 133" which, in the present case, is formed as a circumferential surface. The second shell 13*b'* also has a second pressing element 134'. The second pressing element 134' is also formed as a circumferential surface. In proper use, the first pressing element 133" faces the second pressing element 134".

In this embodiment, to connect the first shell 13*a"* to the second shell 13*b"*, five snap-in connections 15*a"*, 15*b"* are provided, with only one of the snap-in connections 15*a"*, 15*b"* being denoted and explained in more detail in the present case for the sake of clarity. The snap-in connection 15*a"*, 15*b"* has a first element 15*a"* and a second element 15*b"*, with the first element 15*a"* being formed as an opening with undercut and the second element 15*b"* being formed as an elastically deformable projection. During joining, the elements 15*a"* and 15*b"* engage with each other so that a connection between the first shell 13*a"* and the second shell 13*b"* is produced. The first pressing element 133" and the second pressing element 134" subsequently press the walls of the connection seam 17" against each other, so that the connection seam 17" is under pretension (see FIG. 6).

The handle insert 13" according to FIG. 7 is provided with reinforcement ribs 137" which are each arranged between the first pressing element 133" and the associated surface 135" or between the second pressing element 134" and the associated surface 136". To be able to set a specific distance of the pressing elements 134" and 133" to each other, it is possible to provide projections 138" on one of the pressing elements 133" and 134". In the present case, these are formed as nubs which are arranged on an elastic projection.

FIG. 8 shows a further embodiment of a handle insert. FIG. 8 shows a sectional view corresponding to the view of FIG. 2 through a plastic container 1". This plastic container 1" corresponds to that of the plastic container described in FIG. 6. A handle insert 13'" is arranged within the reach-through opening 11". The handle insert 13'" is also arranged completely within the outer contour of the plastic container 1". In the present case, the handle insert 13'" has a first shell **13*a'"* and a second shell 13*b'"*, which are connected to each other along a parting plane 14'". The parting plane 14'" lies substantially in a mold parting plane of the plastic container 1", said mold parting plane not being denoted in greater detail. The handle insert 13'" forms a handle 12'" jointly with a partial region 10*a'"* of the container body 10'". The handle insert 13'" has a first outwardly directed surface 135'" and a second outwardly directed surface 136'". In the present case, "outwardly directed" means that the outer surface or surface in question faces an outer contour of the plastic container 1". The first shell 13*a'"* has a first pressing element 133'" and the second shell 13*b'"* has a second pressing element 134'". In the region of the reach-through opening 11", the container body 10" has a circumferential connection seam 17" which projects from the container body 10" and thus provides an element corresponding to the projection 17 of the exemplary embodiment according to FIG. 4. In the present embodiment, the circumferential connection seam 17" has two substantially planar portions of the walls of the plastic container 10". These planar portions are connected to the plastic container via load-relief notches (not denoted in greater detail). The first pressing element 133'" and the second pressing element 134'" are operatively connected to these walls and thus to the connection seam 17". The first pressing element 133" and the second pressing element 134" press the walls of the connection seam 17" against each other, so that the connection seam 17" is under pretension. The first shell 13*a'"* and the second shell 13*b'"* simultaneously lie against each other via first and second contact surfaces 131'", 132'" (see also FIG. 9** in this regard).

Forces which now occur in this region are thus absorbed by the handle insert 13". The connection seam 17" lying within a contour of the handle insert 13'" is therefore load-relieved.

FIG. 9 shows an exploded view of the handle insert 13'" of FIG. 8 in a three-dimensional view. The handle insert 13' comprises a first shell **13*a'"* and a second shell 13*b'"*. The first shell 13*a'"* has a first contact surface 131'". Arranged along the periphery of the first contact surface 131'" is a first pressing element 133'", which in the present case is formed as a circumferential shoulder. The second shell 13*b'"* also has a second contact surface 132'". A second pressing element 134'" is likewise arranged along the periphery of the second contact surface 132'". The second pressing element 134'" is also formed as a circumferential shoulder. In proper use, the first contact surface 131'" faces the second contact surface 132'"**.

In the present case, the first contact surface 131'", and the second contact surface 132'" are substantially flat. In this embodiment, six plug-in connections are provided to connect the first shell **13*a'"* to the second shell 13*b'"*. Each plug-in connection has a projection 19 and an opening 18. For the sake of clarity, only the elements of one of the plug-in connections are denoted and explained in more detail in the present case. To connect the shell 13*a'"* to the shell 13'", they are moved toward each other and the projections 19 are introduced into the openings 18. The projections have outwardly arranged ribs so that an outer contour of the projections 19 is larger than an inner contour of the openings 18. This allows jamming of the projections 19 in the openings 18. The shells 13*a'"* and 13*b'"*** can thus be securely connected.

The number of connecting elements, for example the number of plug-in connections or also the number of snap-in connections, which are described in the present case, are to be understood as non-limiting. However, at least three connecting elements are preferably provided.

The invention claimed is:

1. A plastic bottle (1, 1") comprising a container body (10), which forms a filling volume for a liquid, and a reach-through opening (11) passing through the container body (10), the container body has two mutually separate cross-sections, which are connected to each other above and below the reach-through opening and thus form commonly the filling volume, wherein the reach-through opening (11) forms a handle (12, 12', 12", 12") with a partial region (**10*a*, 10*a'*, 10*a"*) of the container body (10, 10', 10"), wherein a handle insert (13, 13', 13", 13'") is arranged in the reach-through opening (11, 11"**) and the handle insert extends completely along an inner circumference of the reach-through opening.

2. The plastic container (1, 1") according to claim 1, wherein the handle insert (13, 13', 13", 13'") has two parts that are connectable to each other along a parting plane (14, 14', 14", 14").

3. The plastic container (1, 1") according to claim 2, wherein the two parts of the handle insert (13, 13', 13", 13'", 13", 13'") are a first shell (**13*a*, 13*a'*, 13*a"*, 13*a'"*) and a second shell (13*b*, 13*b'*, 13*b"*, 13*b'"***).

4. The plastic container (1, 1") according to claim 3, wherein the parting plane (14, 14', 14", 14") is formed substantially parallel to a mold parting plane of the plastic container (1, 1").

5. The plastic container (1, 1") according to claim 4, wherein the first shell (**13*a*, 13*a'*, 13*a"*) has a first contact surface (131, 131', 131") and the second shell (13*b*, 13*b'*, 13*b"*) has a second contact surface (132, 132', 132"**) which are directed towards each other.

6. The plastic container (1, 1") according to claim 5, wherein the first contact surface (131, 131', 131") and the second contact surface (132, 132', 132") are connected to each other.

7. The plastic container (1, 1") according to claim 4, wherein the first shell (**13*a'*, 13*a"*) and the second shell (13*b'*, 13*b"*) are connected to each other via a snap-in connection (15*a'*, 15*a"*, 15*b'*, 15*b"***).

8. The plastic container (1, 1") according to claim 1, wherein the plastic container (1, 1") has a circumferential projection (16, 16') within the reach-through opening (11, 11") and the handle insert (13, 13', 13", 13'") has a first pressing element (133, 133', 133", 133'") and a second pressing element (134, 134', 134", 134'"), wherein the first pressing element (133, 133', 133", 133'") and the second pressing element (134, 134', 134", 134'") rest under pretension on the projection (16, 16').

9. The plastic container (1, 1") according to claim 8, wherein the connection seam (17, 17') is formed as part of the projection (16, 16').

10. The plastic container (1, 1") according to claim 8, wherein the first pressing element (133) and/or the second pressing element (134) is formed in several parts.

11. The plastic container (1, 1") according to claim 1, wherein a circumferential connection seam (17, 17', 17'") is arranged within the reach-through opening (11, 11").

12. The plastic container (1, 1") according to claim 1, wherein the handle insert (13, 13', 13", 13'") has reinforcing ribs, in particular arranged between a corresponding pressing element (133', 133", 134', 134'") and an associated surface (135', 135", 136', 136").

13. The plastic container (1, 1") according to claim 1, wherein the plastic container (1, 1") is a stretch blow-molded plastic container.

14. The plastic container (1, 1") according to claim 13, wherein the plastic container (1, 1") is produced from a material selected from the group consisting of PET, PET-G, HDPE, LDPE, PP, PS, PVC, PEN, PHA, PHB, PEIT, PCTG, LLDPE, MDPE and copolymers of the plastics named, bioplastics, filled plastics, and mixtures of the plastics named.

15. The plastic container (1, 1") according to claim 1, wherein the handle insert (13, 131, 13", 13'") is an injection-molded part.

16. The plastic container (1, 1") according to claim 15, wherein the handle insert (13, 13', 13", 13'") is produced from a material selected from the group consisting of PET, PET-G, HDPE, LDPE, PP, PS, PVC, PEN, PHA, PHB, PEIT, PCTG, LLDPE, MDPE and copolymers of the plastics named, bioplastics, filled plastics, and mixtures of the plastics named.

17. The plastic container (1, 1") according to claim 1, wherein the handle insert (13, 13', 13", 13'") and the plastic container (1, 1") are made of the same material.

* * * * *